United States Patent [19]

Johnson et al.

[11] Patent Number: 4,978,482

[45] Date of Patent: Dec. 18, 1990

[54] MELT CAST THERMOPLASTIC ELASTOMERIC PLASTIC BONDED EXPLOSIVE

[75] Inventors: Nancy C. Johnson, Waldorf; Robert C. Gill, White Plains; John F. Leahy, Bowie; Carl Gotzmer, Jr., Accokeek; Harold T. Fillman, Bowie, all of Md.

[73] Assignee: The United States of America as represented by the Secretary of the Navy, Washington, D.C.

[21] Appl. No.: 665,906

[22] Filed: Oct. 29, 1984

[51] Int. Cl.[5] ..... C06B 45/10

[52] U.S. Cl. ..... 264/3.1; 149/19.9; 149/19.91; 149/19.92

[58] Field of Search ..... 149/19.9, 19.92, 19.91; 264/3.1

[56] References Cited

U.S. PATENT DOCUMENTS

| | | | |
|---|---|---|---|
| 3,338,764 | 8/1967 | Evans | 149/19.9 |
| 3,449,179 | 6/1969 | Minekawa et al. | 149/19.9 |
| 3,501,357 | 3/1970 | Suzuki et al. | 149/19.9 |
| 4,113,811 | 9/1978 | Helfgen et al. | 149/19.92 |
| 4,168,191 | 9/1979 | Benziger et al. | 149/19.91 |
| 4,177,227 | 12/1979 | Harvey et al. | 149/19.9 |
| 4,361,526 | 11/1982 | Allen | 149/19.9 |

OTHER PUBLICATIONS

Johnson et al, *J. Hazardous Materials*, 9 (1984), 41-45.

*Kraton® Thermoplastic Rubber*, Shell Chemical Co., Technical Bulletin, SC 65-75.

*Primary Examiner*—Edward A. Miller

*Attorney, Agent, or Firm*—Kenneth E. Walden; Roger D. Johnson

[57] ABSTRACT

A method of melt casting plastic bonded explosives by:

A. forming a uniform binder mixture of the following ingredients (1) from 10 to 30 weight percent of a triblock polymer of the formula A-B-A wherein A represents a polystyrene block and B represents an elastomeric midblock which is selected from the group consisting of polybutadiene, polyisoprene, and polyethylenebutylene; and (2) From 70 to 90 weight percent of a low viscosity oil selected from the group consisting of naphthenic, paraffinic, and olefinic oils by mixing the ingredients under low-shear conditions at a temperature of from 80° C. to 110° C.;

B. mixing an energetic filler into the binder mixture under low shear conditions and at a temperature of from 80° C. to 110° C., provided that the viscosity of the mixture does not exceed 20 kilopoise;

C. pouring the energetic filler-binder mixture formed in step B into a mold; and D. cooling energetic filler-binder mixture to form a solid explosive composite.

Rubber phase associating and polystyrene phase associating hot melt resins may also be used in the binder mixture to improve the physical properties of the final plastic bonded explosive composite.

19 Claims, No Drawings

MELT CAST THERMOPLASTIC ELASTOMERIC PLASTIC BONDED EXPLOSIVE

BACKGROUND OF THE INVENTION

This invention relates to high energy explosives and more particularly to high energy plastic bonded explosives.

Older melt cast explosives which are based on crystalline TNT are being replaced by safer, more stable curable elastomeric plastic bonded explosives (PBX's). Unfortunately, known methods of preparing PBX's are expensive and difficult, requiring the use of high shear mixers (Baker-Perkins). Because high shear mixers are in short supply, sufficient quantities of these PBX's could not be produced for rapid mobilization. Thus, in a serious emergency, use of the older, more dangerous TNT based melt cast explosives would be necessary.

Also it would be desirable to reduce the cost of preparing the elastomeric plastic bonded explosives. The high shear mixing equipment an processing is very expensive. Additionally, solvents, crosslinking agents, curing agents, and curing or drying ovens are needed.

Therefore it would be desirable to provide a solventless, low-shear mixing method of producing plastic bonded explosives.

SUMMARY OF THE INVENTION

Accordingly, an object of this invention is to provide a new method of producing plastic bonded explosive (PBX) composites.

Another object of this invention is to provide a less expensive method of preparing plastic bonded explosives.

A further object of this invention is to provide a solventless process for producing plastic bonded explosive which does not require high-shear mixing.

These and other objects of this invention are accomplished by providing a method of melt casting plastic bonded explosives comprising:

A. forming a uniform binder mixture cf the following ingredients
   (1) from 10 to 30 weight percent cf a triblock polymer of the formula A-B-A wherein A represents a polystyrene block and B represents an elastomeric midblock which is selected from the group consisting of polybutadiene, polyisoprene, and polyethylenebutylene; and
   (2) From 70 to 90 weight percent cf a low viscosity oil selected from the group consisting of naphthenic, paraffinic, and olefinic oils
   by mixing the ingredients under low-shear conditions at a temperature of from 80° C. to 110° C.;
B. mixing an energetic filler into the binder mixture under low shear conditions and at a temperature of from 80° C. to 110° C., provided that the viscosity of the mixture does not exceed 20 kilopoise;
C. pouring the energetic filler-binder mixture formed in step B into a mold; and
D. cooling energetic filler-binder mixture to form a solid explosive composite.

Rubber phase associating and polystyrene phase associating hot melt resins may also be used in the binder mixture to improve the physical properties of the final plastic bonded explosive composite.

DETAILED DESCRIPTION OF THE PREFERRED EMBODIMENT

The method of the present invention produces plastic bonded explosive composites without the use of solvents and without the use of high-shear mixing equipment. In order to accomplish this, a thermoplastic binder system having a low viscosity in the temperature range of from 80° C. to 110° C. is used The binder system comprises (1) from 10 to 30 weight percent of a polystyrene-elastomeric polymer-polystyrene triblock polymer and (2) a compatible low viscosity oil which comprises the remainder of the binder system.

The triblock polymers used can be represented by the formula A-B-A wherein A represents an end block of polystyrene and B represents a midblock of a elastomeric polymer which is polyisoprene, polybutadiene, and polyethylenebutylene. Of these elastomeric polymers, polyethylenebutylene is preferred because it is saturated and therefore is more resistant to aging. The elastomeric midblock (B) provides the triblock polymer with its stretchy or rubbery properties.

The polystyrene end blocks (A) provide the triblock polymer with its thermoplastic properties. At temperatures below the glass transition temperature of styrene (100° C.), the polystyrene blocks of separate polymer chains associate to form glassy domains which physically crosslink the chains together. In contrast, at temperatures above 100° C. the attraction between polystyrene blocks is overcome and thermoplastic flow occurs. The triblock polymers which are used in this process are well known in the art. They are available for example from the Shell Chemical Company, 1415 West 22nd Street, Oak Brook, Ill. 60521, under the trade name Kraton®. Specific examples of these triblock polymers are Kraton®D1101, a polystyrene-polybutadiene-polystyrene; Kraton®D1107, a polystyrene-polyisoprene-polystyrene; and Kraton®G1657, a polystyrene-polyethelenetutylenepolystyrene Another example is Kraton® G1652, a polystyrene-polyethylenebutylene-polystyrene which is used in the examples.

Although the thermoplastic styrene domains soften at temperatures above 100° C. unlocking the physical crosslinking mechanism, the polymers will not flow even at temperatures of 120° to 150° C. unless high shear energy is applied. However, when the polymers are plasticized with sufficient amounts of low viscosity naphthenic, paraffinic, or olefinic oils, the resulting binder systems can be processed in conjunction with energetic fillers in the 80 to 110° C. (preferably 90° C. to 100° C.) temperature range under low shear conditions to produce plastic bonded explosives. Examples of oils which are suitable include Shellflex®371 naphthenic oil from Shell Chemical Company, 1415 West 22nd Street, Oak Brook Ill. 60521, and Tufflo®6016 hydrocarbon oil from ARCO (Atlantic Richfield Co.), Philadelphia, Pa. Oil is added to the polymer until a vicosity of less than 300 poise, and preferably less than 200 poise, at 100° C. is achieved in the binder system. From about 10 to about 30, and preferably from 18 to 22 weight percent of the polymer oil binder system is the polymer with the remainder being the oil. The oil and polymer are blended with a low-shear mixer at a temperature of from 80° C. to 110° C., preferable from 90° C. to 100° C. until a homogeneous mixture is obtained.

While maintaining this temperature particles of the energetic material are blended into the polymer-oil mixture using a low-shear mixer. The choice of energetic filler materials is not critical to this invention. In addition to conventional explosives such as RDX, HMX, and TATB, high energy fuels such as powdered aluminum may also be added. As the filler is added the viscosity of the mixture increases. Care is taken so that the viscosity is kept below 20 kilopoise, and preferably is less than 10 kilopoise at the mixing temperature. Usually, a mixture of from 80 to 85 weight percent of energetic filler with the remaining 15 to 20 weight percent being the polymer and oil binder system is attainable before the viscosity becomes too great.

Finally, the molten explosive mixture is poured into molds or containers and allowed to cool in the desired shapes.

The process can be modified by replacing some of the low viscosity oil with a hot melt resin which associates with the elastomeric midblock (B) of the polystyrene-elastomeric polymer-polystyrene triblock polymer (A-B-A). These rubber phase associating resins help to plasticize the triblock polymer and enhance the stretchy or rubbery properties of the polymer. Some examples of these resins are Pentalyn ®H, a pentaerythritol ester of rosin; Foral ®85, a glycerol ester of highly stabilized rosin; and Piccofyn ®A-100 a terpene phenolic; all of which are available from Hercules, Inc., Wilmington, Del. The binder mixture comprises from 15 to 25 weight percent of the polystyrene-elastomeric polymer-polystyrene triblock polymer, from 40 to 60 weight percent of the low viscosity oil, and from 20 to 45 weight percent of the rubber phase associating hot melt resin. A preferred binder mixture comprises from 18 to 22 weight percent of the triblock polymer, from 40 to 50 weight percent of the low viscosity oil, and from 30 to 40 weight percent of the rubber phase associating hot melt resin The ingredients in this mixture are also blended with a low-shear mixer at a temperature of from 80° C. to 110° C., or preferably from 90° C. to 100° C..

The process can also be modified by replacing some of the low viscosity oil with a hot melt resin which associates with the polystyrene end blocks (A) of the polystyrene-elastomeric polymer-polystyrene triblock polymer (A-B-A). This last resin is attracted to and associates with the polystyrene glassy domains and increases the hardness of the triblock polymer below the glass transition temperature range and also helps to plasticize the polymer. An example of a polystyrene phase associating resin is Piccotex ®100, a polyalphamethylstyrene/vinyl toluene copolymer available from Hercules, Inc., Wilmington, Del. This binder mixture comprises from 15 to 25 weight percent of the polystyrene-elastomeric polymer-polystyrene triblock polymer, from 40 to 70 weight percent of the low viscosity oil, and from 10 to 45 weight percent of the polystyrene phase associating resin. Preferably, this binder mixture comprises from 18 to 22 weight percent of the triblock polymer, from 50 to 60 weight percent of low viscosity oil, and from 20 to 30 weight percent of polystyrene phase associating resin. This binder mixture is also blended under low-shear conditions at a temperature of from 80° C. to 110° C., or preferably from 90° C. to 100° C..

A combination of both rubber phase associating and polystyrene phase associating hot melt resins may also be used to replace part of the low viscosity oil. The binder mixture comprises from 15 to 25 weight percent of the polystyrene-elastomeric polymer-polystyrene triblock polymer, from 40 to 70 weight percent of the low viscosity oil, from 10 to 30 weight percent of the rubber phase associating resin, and from 5 to 15 weight percent of the polystyrene phase associating resin. Preferably, this binder mixture comprises from 18 to 22 weight percent of the triblock polymer, from 50 to 65 weight percent of low viscosity oil, from 10 to 20 weight percent of rubber phase associating resin, and from 5 to 10 weight percent of polystyrene phase associating resin. This binder mixture is also blended under low-shear conditions at a temperature of from 80° C. to 110° C., or preferably from 90° C. to 100° C.

The general nature of the invention having been set forth, the following examples are presented as specific illustrations thereof It will be understood that the invention is not limited to these examples but is susceptible to various modifications that will be recognized by one of ordinary skill in the art.

EXAMPLES

Listed in Table I are compositions and properties of melt cast binder systems suitable for forming plastic explosives using the methods of this invention. Included in the table are physical property data, viscosities, and glass transition temperatures Mixes 1, 2, and 3 are composites which contain a polystyrene-polyethylenebutylene-polystyrene triblock polymer (Kraton ®G1652) and a low viscosity oil (Tufflo ®6016, Shellflex ®371). Mixes 4, 5, 7–11, 13, and 14 contain the triblock polymer, low viscosity oil and a rubber phase associating hot melt resin (Foral ®85, Piccofyn ®A100, Pentalyn H) Mixes 15 and 16 contain the triblock polymer, low viscosity oil, and a polystyrene phase associating hot melt resin (Piccotex ®). Mixes 6 and 12 contain the triblock polymer, low viscosity oil, rubber phase associating hot melt resin, and polystyrene phase associating hot melt resin. All of the binder compositions could be processed at 90°–100° C. No evidence of plasticizer oil exuding from the compositions has been observed.

Table II lists a plastic bonded explosive composition which was prepared according to the methods of this invention using a binder mixture of 20 weight percent of polystyrenepolyethylenebutylene-polystyrene triblock polymer (Kraton ® G1652) and 80 weight percent of a low viscosity oil (Tufflo ® 6016). This explosive composition would be typical of PBXW-108 plastic bonded explosive in both solids loading and energy The mechanical properties of this explosive composition are comparable to those of PBXW-108 at 25° C. and are listed in Table III. This composition processed well in a 2-gallon Anchor mixer; it had an end-of-mix viscosity of 3.5 kilopoise at 93° C. and cast well.

TABLE I

Compositions and Properties of Melt Case Binders

| | Mix # | | | | | | | |
|---|---|---|---|---|---|---|---|---|
| | 1 | 2 | 3 | 4 | 5 | 6 | 7 | 8 |
| Formulation, wt. % | | | | | | | | |
| Kraton G1652 | 20 | 25 | 20 | 20 | 22 | 22 | 20 | 20 |
| Tufflo 6016 Oil | 80 | 75 | 0 | 0 | 0 | 0 | 0 | 0 |

TABLE I-continued

| Compositions and Properties of Melt Case Binders | | | | | | | | |
|---|---|---|---|---|---|---|---|---|
| Shellflex 371 Oil | 0 | 0 | 80 | 45 | 45 | 58 | 55 | 53 |
| Foral 85 Resin | 0 | 0 | 0 | 35 | 33 | 14 | 0 | 0 |
| Piccofyn A100 Resin | 0 | 0 | 0 | 0 | 0 | 0 | 25 | 27 |
| Pentalyn H Resin | 0 | 0 | 0 | 0 | 0 | 0 | 0 | 0 |
| Piccotex 100 Resin | 0 | 0 | 0 | 0 | 0 | 6 | 0 | 0 |
| Viscosity, Poise (100° C.) | 73 | 390 | 83 | 150 | 300 | 200 | 120 | 150 |
| Physical Property (25° C.) | | | | | | | | |
| Stress, psi | 6 | 50 | 12 | 240 | 530 | 140 | 94 | 190 |
| Strain, % | 210 | 340 | 360 | 1530 | 2110 | 990 | 1030 | 1490 |
| Glass Transition Temp., °C. | −78 | — | −89 | −100 | — | — | — | — |

| | Mix # | | | | | | | |
|---|---|---|---|---|---|---|---|---|
| | 9 | 10 | 11 | 12 | 13 | 14 | 15 | 16 |
| Formulation, wt. % | | | | | | | | |
| Kraton G1652 | 20 | 20 | 22 | 20 | 20 | 20 | 20 | 20 |
| Tufflo 6016 Oil | 0 | 0 | 0 | 0 | 0 | 0 | 60 | 0 |
| Shellflex 371 Oil | 50 | 45 | 53 | 60 | 55 | 45 | 0 | 60 |
| Foral 85 Resin | 0 | 0 | 0 | 0 | 0 | 0 | 0 | 0 |
| Piccofyn A100 Resin | 30 | 35 | 25 | 14 | 0 | 0 | 0 | 0 |
| Pentalyn H Resin | 0 | 0 | 0 | 0 | 25 | 35 | 0 | 0 |
| Piccotex 100 Resin | 0 | 0 | 0 | 6 | 0 | 0 | 20 | 20 |
| Viscosity, Poise (100° C.) | 170 | 300 | 230 | 130 | 110 | 200 | 86 | 200 |
| Physical Property (25° C.) | | | | | | | | |
| Stress, psi | 280 | 190 | 190 | 110 | 98 | 230 | 30 | 75 |
| Strain, % | 1730 | 1230 | 1480 | 990 | 990 | 1540 | 690 | 950 |
| Glass Transition Temp., °C. | — | — | — | — | — | — | — | — |

TABLE II

| Plastic Bonded Explosive Composition | |
|---|---|
| Ingredients | Wt. % |
| Kraton G1652 | 3.0 |
| Tufflo 6016 | 12.0 |
| RDX C | 59.5 |
| RDX E | 25.5 |
| End of mix viscosity at 93° C. (KP) | 3.5 |

TABLE III

| Mechanical Properties of Plastic Bonded Explosive Composition from Table II Versus PBXW-108E at 25° C. | | | | | |
|---|---|---|---|---|---|
| Compositions | Sm (psi) | Sr (psi) | Em (%) | Er (%) | Shore A Hardness |
| PBX From Table II | 30 | 29 | 16 | 16 | 24 |
| PBXW-108E | 34 | 34 | 19 | 19 | 28 |

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A method of melt casting plastic bonded explosives comprising:

A. forming a uniform binder mixture by mixing the following ingredients under low-shear conditions at a temperature of from 80° C. to 110° C.:

(1) from 18 to 22 weight percent of a triblock polymer of the formula A-B-A wherein A represents a polystyrene block and B represents an elastomeric midblock which is selected from the group consisting of polybutadiene, polyisoprene, and polyethylenebutylene, and (2) from 78 to 82 weight percent of a low viscosity oil selected from the group consisting of naphthenic, paraffinic, and olefinic oils, provided that the sum of the weight percents of the triblock polymer and the oil equals 100 weight percent and provided that the viscosity of the binder mixture is less than 300 poise at 100° C;

B. mixing an energetic filler into the binder mixture under low shear conditions and at a temperature of from 80° C. to 110° C., provided that the viscosity of the mixture does not exceed 20 kilopoise.

C. pouring the energetic filler-binder mixture formed in step B into a mold; and D. cooling energetic filler-binder mixture to form a solid explosive composite.

2. The method of claim 1 wherein the elastomeric midblock, B, of the triblock polymer is polyethylene butylene.

3. The method of claim 1 wherein the temperatures used in steps A and B are in the range of from 90° C. to 100° C.

4. The method of claim 1, wherein the viscosity of the energetic filler-binder mixture in step B does not exceed 10 kilopoise.

5. A method of melt casting plastic bonded explosives comprising:

A. forming a uniform binder mixture by mixing the following ingredients under low-shear conditions at a temperature of from 80° C. to 110° C.:

(1) from 18 to 22 weight percent of a triblock polymer of the formula A-B-A wherein A represents a polystyrene block and B represents an elastomeric midblock which is selected from the group consisting of polybutadiene, polyisoprene, and polyethylenebutylene, (2) from 40 to 50 weight percent of a low viscosity oil selected from the group consisting of naphthenic, paraffinic, and olefinic oils, and (3) from 30 to 40 weight percent of a rubber phase associating hot melt resin, provided that the sum of the weight percents of the triblock polymer, the low viscosity oil, and the rubber phase associating hot melt resin is 100 weight percent and provided that the viscosity of the binder mixture is less than 300 poise at 100° C.;

B. mixing an energetic filler into the binder mixture under low-shear conditions and at a temperature of from 80° C. to 110° C., provided that the viscosity of the mixture does not exceed 20 kilopoise;

C. pouring the energetic filler-binder mixture formed in step B into a mold; and D. cooling energetic filler-binder mixture to form a solid explosive composite.

6. The method of claim 5 wherein the elastomeric midblock, B, of the triblock polymer is polyethylenebutylene.

7. The process of claim 5 wherein the rubber phase associating hot melt resin is selecting from the group consisting of pentaerythritol esters of rosin, glycerol esters of highly stabilized rosin, and terpene phenolics.

8. The method of claim 5 wherein the temperatures used in steps A and B are in the range of from 90° C. to 100° C.

9. The method of claim 5 wherein the viscosity of the energetic filler-binder mixture in step B does not exceed 10 kilopoise.

10. A method of melt casting plastic bonded explosives comprising:

A. forming uniform binder mixture by mixing the following ingredients under low-shear conditions at a temperature of from 80° C. to 110° C.:

(1) from 18 to 22 weight percent of a triblock polymer of the formula A-B-A wherein A represents a polystyrene block and B represents an elastomeric midblock which is selected from the group consisting of polybutadiene, polyisoprene, and polyethylenebutylene, (2) from 50 to 60 weight percent of a low viscosity oil selected from the group consisting of naphthenic paraffinic, and olefinic oils, and (3) from 20 to 30 weight percent of a polystyrene phase associating hot melt resin, provided that the sum of the weight percents of the triblock polymer, the low viscosity oil, and the polystyrene phase association hot melt resin is 100 weight percent and provided that the viscosity of the binder mixture is less than 300 poise at 100° C.;

B. mixing an energetic filler into the binder mixture under low-shear conditions and at a temperature of from 80° C. to 110° C., provided that the viscosity of the mixture does not exceed 20 kilopoise;

C. pouring the energetic filler-binder mixture formed in step B into a mold; and D. cooling energetic filler-binder mixture to form a solid explosive composite.

11. The method of claim 10 wherein the elastomeric midblock, B, of the triblock polymer is polyethylenebutylene.

12. The method of claim 10 wherein the polystyrene phase associating hot melt resin is a polyalphamethyl styrene/vinyl toluene copolymer.

13. The method of claim 10 wherein the temperatures used in steps A and B are in the range of from 90° C. to 100° C.

14. The method of claim 10 wherein the viscosity of the energetic filler-binder mixture in step B does not exceed 10 kilopoise.

15. A method of melt casting plastic bonded explosives comprising:

A. forming a uniform binder mixture by mixing the following ingredients under low-shear conditions at a temperature of from 80° C. to 110° C.:

(1) from 18 to 22 weight percent of a triblock polymer of the formula A-B-A wherein A represents a polystyrene block and B represents an elastomeric midblock which is selected from the group consisting of polybutadiene, polyisoprene, and polyethylenebutylene;

(2) from 50 to 65 weight percent of a low viscosity oil selected from the group consisting of naphthenic, paraffinic, and olefinic oils, (3) from 10 to 20 weight percent of a rubber phase associating hot melt resin, and (4) from 5 to 10 weight percent of a polystyrene phase associating hot melt resin, provided that the sum of the weight percents of the triblock polymer, the low viscosity oil, the rubber phase associating hot melt resin, and the polystyrene phase associating hot melt resin is 100 weight percent and provided that the viscosity of the binder mixture is less than 300 poise at 100° C.;

B. mixing an energetic filler into the binder mixture under low-shear conditions and at a temperature of from 80° C. to 110° C., provided that the viscosity of the mixture does not exceed 20 kilopoise;

C. pouring the energetic filler-binder mixture formed in step B into a mold; and D. cooling energetic filler-binder mixture to form a solid explosive composite.

16. The method of claim 15 wherein the elastomeric midblock, B, of the triblock polymer is polyethylenebutylene.

17. The method of claim 15 wherein the rubber phase associating hot melt resin is selecting from the group consisting of pentaerythritol esters of rosin, glycerol esters of highly stabilized rosin, and terpene phenolics and wherein the polystyrene phase associating hot melt resin is a polyalphamethyl styrene/vinyl toluene copolymer.

18. The method of claim 15 wherein the temperatures used in steps A and B are in the range of from 90° C. to 100° C.

19. The method of claim 15 wherein the viscosity of the energetic filler/binder mixture in step B does not exceed 10 kilopoise.

* * * * *